US008119227B2

(12) United States Patent
Reineck et al.

(10) Patent No.: US 8,119,227 B2
(45) Date of Patent: Feb. 21, 2012

(54) COATED CUTTING TOOL

(75) Inventors: Ingrid Reineck, Segeltorp (SE); Marianne Collin, Älvsjö (SE); David Huy Trinh, Linköping (SE); Hans Högberg, Linköping (SE); Lars Hultman, Linköping (SE)

(73) Assignee: Sandvik Intellectual Property AB, Sandviken (SE)

( * ) Notice: Subject to any disclaimer, the term of this patent is extended or adjusted under 35 U.S.C. 154(b) by 497 days.

(21) Appl. No.: 11/905,171

(22) Filed: Sep. 27, 2007

(65) Prior Publication Data

US 2008/0131677 A1 Jun. 5, 2008

(30) Foreign Application Priority Data

Oct. 18, 2006 (SE) ..... 0602192
Oct. 18, 2006 (SE) ..... 0602193

(51) Int. Cl.
*B32B 9/00* (2006.01)

(52) U.S. Cl. ..... 428/216; 51/307; 51/309; 428/336; 428/325; 428/697; 428/698; 428/699; 428/701; 428/702

(58) Field of Classification Search ..... 51/307, 51/309; 428/216, 336, 325, 697, 698, 699, 428/701, 702
See application file for complete search history.

(56) References Cited

U.S. PATENT DOCUMENTS 4,346,123 A 8/1982 Kaufmann
4,619,866 A 10/1986 Smith et al.
4,701,384 A 10/1987 Sarin et al.
4,702,970 A 10/1987 Sarin et al.
4,749,629 A * 6/1988 Sarin et al. ..... 428/701
5,147,731 A * 9/1992 Gilmore et al. ..... 428/697
5,789,071 A * 8/1998 Sproul et al. ..... 428/702
5,827,570 A * 10/1998 Russell ..... 427/255.34
6,103,357 A 8/2000 Selinder et al.
6,660,371 B1 12/2003 Westphal et al.

(Continued)

FOREIGN PATENT DOCUMENTS

DE 27 36 982 A1 3/1979

(Continued)

OTHER PUBLICATIONS

Qadri et al "Structural stability of ZrO2-Al2O3 thin films deposirited by magnetron sputtering" J. Vac Sci. Tech A 7 (3) May/Jun. 1989 p. 1220-1224.*

(Continued)

*Primary Examiner* — Archene Turner
(74) *Attorney, Agent, or Firm* — Morgan, Lewis & Bockius LLP

(57) ABSTRACT

A cutting tool includes a substrate on which at least on the functioning parts of the surface thereof a thin, adherent, hard and wear resistant coating is applied, wherein the coating includes a laminated multilayer of alternating PVD or PECVD metal oxide layers, $Me_1X+Me_2X+Me_1X+Me_2X$ . . . , where at least one of $Me_1X$ and $Me_2X$ is a metal oxide+metal oxide nano-composite layer composed of two components, wherein the layers $Me_1X$ and $Me_2X$ are different in composition or structure, the laminated multilayer layer has a compositional gradient, with regards to a concentration, in a direction from an outer surface of the coating towards the substrate, the gradient being such that a difference between an average concentration of an outermost portion of the multilayer and an average concentration of an innermost portion of the multilayer is at least about 5 at-% in absolute units.

16 Claims, 1 Drawing Sheet

U.S. PATENT DOCUMENTS

| | | | | |
|---|---|---|---|---|
| 7,326,461 | B2 * | 2/2008 | Sottke et al. | 428/336 |
| 7,597,951 | B2 * | 10/2009 | Bjormander et al. | 428/216 |
| 2005/0260432 | A1 | 11/2005 | Sottke et al. | |
| 2006/0257691 | A1 * | 11/2006 | Trinh et al. | 428/698 |

FOREIGN PATENT DOCUMENTS

| | | | |
|---|---|---|---|
| EP | 0 709 483 | | 4/2002 |
| EP | 1 717 347 | | 11/2006 |
| JP | 61-201778 | * | 9/1986 |
| JP | 61-270374 | * | 11/1986 |
| JP | 04-246174 | A | 9/1992 |
| SE | 0500648 | | 10/2006 |
| SE | 529 143 | | 5/2007 |
| SE | 529 144 | | 5/2007 |
| WO | 99/58738 | | 11/1999 |
| WO | 2004/029321 | | 4/2004 |
| WO | WO 2004/033751 | A1 | 4/2004 |
| WO | WO-2006029747 | A2 | 3/2006 |

OTHER PUBLICATIONS

Andritschky et al "Thermal stability of zirconia/alumina thin coatings produced by magnetron sputtering" Surf. and Coat. Tech 94-95 (1997) p. 144-148.*

Teixeira et al "Deposition of composite and nanolaminate ceramic coatings by sputtering" Vacuum (2002) p. 477-483.*

Portinha et al "Mechanical properties of ZrO2-Al2O3 nanostructured PVD coatings evaluated by nanoindentation" Rev. Adv. Mat. Sci. 5 (2003) p. 311-318.*

Henryk Tomaszewski et al., *Influence of Oxygen Content in a Sintering Atmosphere on the Phase Composition and Mechanical Properties of $Al_2O_3$-10wt% $ZrO_2$ Ceramics*, Journal of Materials Science Letters, vol. 7 (1988), pp. 778-780.

Anthony G. Evans, *Perspective on the Development of High-Toughness Ceramics*, J. Am. Ceram. Soc., vol. 73 (1990), pp. 187-206.

S. Ben Amor et al., *Characterization of Zirconia Films Deposited by R.F. Magnetron Sputtering*, Materials Science and Engineering, vol. B57 (1998), pp. 28-39.

Richard H. J. Hannink et al., *Transformation Toughening in Zirconia-Containing Ceramics*, J. Am. Ceram. Soc., vol. 83 (2000), pp. 461-487.

Joshua D. Kuntz et al., *Nanocrystalline-Matrix Ceramic Composites for Improved Fracture Toughness*, MRS Bulletin, Jan. 2004, pp. 22-27.

European Search Report dated May 29, 2009 issued in European Application No. 07 11 7460.

* cited by examiner

COATED CUTTING TOOL

CROSS-REFERENCE TO RELATED APPLICATIONS

This application claims priority under 35 U.S.C. §119 and/or §365 to Swedish Application No. 0602192-7, filed Oct. 18, 2006, and to Swedish Application No. 0602193-5, filed Oct. 18, 2006, the entire contents of each of these applications are incorporated herein by reference.

BACKGROUND OF THE INVENTION

The present invention relates to a coated cutting tool for metal machining having a substrate of a hard alloy and, on the surface of said substrate, a hard and wear resistant refractory coating is deposited by Physical Vapor Deposition (PVD) or Plasma Enhanced Chemical Vapor Deposition (PECVD).

The process of depositing thin ceramic coatings (from about 1 to about 20 μm) of materials like alumina, titanium carbides and/or nitrides onto e.g. a cemented carbide cutting tool is a well established technology and the tool life of the coated cutting tool, when used in metal machining, is considerably prolonged. The prolonged service life of the tool may under certain conditions extend up to several hundred percent greater than that of an uncoated cutting tool. These ceramic coatings generally comprise either a single layer or a combination of layers. Modern commercial cutting tools are characterized by a plurality of layer combinations with double or multilayer structures. The total coating thickness varies between about 1 and about 20 μm and the thickness of the individual sub-layers varies between a few micrometers down to some hundredths of a micrometer.

The established technologies for depositing such layers are CVD and PVD (see e.g. U.S. Pat. No. 4,619,866 and U.S. Pat. No. 4,346,123). PVD coated commercial cutting tools of cemented carbides or high speed steels usually have a single layer of TiN, Ti(C,N) or (Ti,Al)N, homogeneous in composition, or multilayer coatings of said phases, each layer being a single phase material.

There exist several PVD techniques capable of producing thin, refractory coatings on cutting tools. The most established methods are ion plating, magnetron sputtering, arc discharge evaporation and IBAD (Ion Beam Assisted Deposition) as well as hybrid processes of the mentioned methods. Each method has its own merits and the intrinsic properties of the produced layers such as microstructure and grain size, hardness, state of stress, cohesion and adhesion to the underlying substrate may vary depending on the particular PVD method chosen. An improvement in the wear resistance or the edge integrity of a PVD coated cutting tool being used in a specific machining operation can thus be accomplished by optimizing one or several of the above mentioned properties.

Particle strengthened ceramics are well known as construction materials in the bulk form, however not as nano-composites until recently. Alumina bulk ceramics with different nano-dispersed particles are disclosed in J. F. Kuntz et al, MRS Bulletin January 2004, pp 22-27. Zirconia and titania toughened alumina CVD layers are disclosed in for example U.S. Pat. No. 6,660,371, U.S. Pat. No. 4,702,907 and U.S. Pat. No. 4,701,384. In these latter disclosures, the layers are deposited by CVD technique and hence the $ZrO_2$ phase formed is the thermodynamically stable phase, namely the monoclinic phase. Furthermore, the CVD deposited layers are in general under tensile stress or low level compressive stress, whereas PVD or PECVD layers are typically under high level compressive stress due to the inherent nature of these deposition processes. In US 2005/0260432 blasting of alumina+zirconia CVD layers is described to give a compressive stress level. Blasting processes are known to introduce compressive stresses at moderate levels.

Metastable phases of zirconia, such as the tetragonal or cubic phases, have been shown to further enhance bulk ceramics through a mechanism known as transformation toughening (Hannink et al, J. Am. Ceram. Soc 83 (3) 461-87; Evans, Am. Ceram. Soc. 73 (2) 187-206 (1990)). Such metastable phases have been shown to be promoted by adding stabilizing elements such as Y or Ce or by the presence of an oxygen deficient environment, such as vacuum (Tomaszewski et al, J. Mater. Sci. Lett 7 (1988) 778-80), which is typically required for PVD applications. Variation of PVD process parameters has been shown to cause variations in the oxygen stoichiometry and the formation of metastable phases in zirconia, particularly the cubic zirconia phase (Ben Amor et al, Mater. Sci. Eng. B57 (1998) 28).

Multilayered PVD layers consisting of metal nitrides or carbides for cutting applications are described in EP 0709483 where a symmetric multilayer structure of metal nitrides and carbides is revealed and U.S. Pat. No. 6,103,357 which describes an aperiodic laminated multilayer of metal nitrides and carbides.

Swedish Patent Nos. SE 529 144 C2 and SE 529 143 C2 disclose a cutting tool insert for metal machining on which at least on the functioning parts of the surface thereof a thin, adherent, hard and wear resistant coating is applied. The coating comprises a metal oxide+metal oxide nano-composite layer consisting of two components with a grain size of 1-100 nm.

OBJECTS AND SUMMARY OF THE INVENTION

It is an object of the present invention to provide a PVD or PECVD coated cutting tool wherein the coating has improved wear resistance in combination improved adhesion properties.

In one embodiment of the invention, there is provided a cutting tool comprising a substrate of cemented carbide, cermet, ceramics, cubic boron nitride or high speed steel on which at least on the functioning parts of the surface thereof a thin, adherent, hard and wear resistant coating is applied, wherein said coating comprises a laminated multilayer of alternating PVD or PECVD metal oxide layers, $Me_1X+Me_2X+Me_1X+Me_2X$ . . . , where the metal atoms $Me_1$ and $Me_2$ are one or more of Ti, Nb, V, Mo, Zr, Cr, Al, Hf, Ta, Y and Si, and where at least one of $Me_1X$ and $Me_2X$ is a metal oxide+metal oxide nano-composite layer composed of two components, component A and component B, with different composition and different structure which components comprise a single phase oxide of one metal element or a solid solution of two or more metal oxides, wherein the layers $Me_1X$ and $Me_2X$ are different in composition or structure or both and have individual layer thicknesses larger than about 0.4 nm but smaller than about 50 nm and where said laminated multilayer has a total thickness of between about 0.2 and about 20 μm and has a compositional gradient, with regard to the concentration of one or more of the metal atom(s), in the direction from the outer surface of the coating towards the substrate, the gradient being such that the difference in between the average concentration of the outermost portion of the multilayer and the average concentration of the innermost portion of the multilayer is at least about 5 at-% in absolute units.

DETAILED DESCRIPTION OF THE PREFERRED EMBODIMENTS

Figure 1:
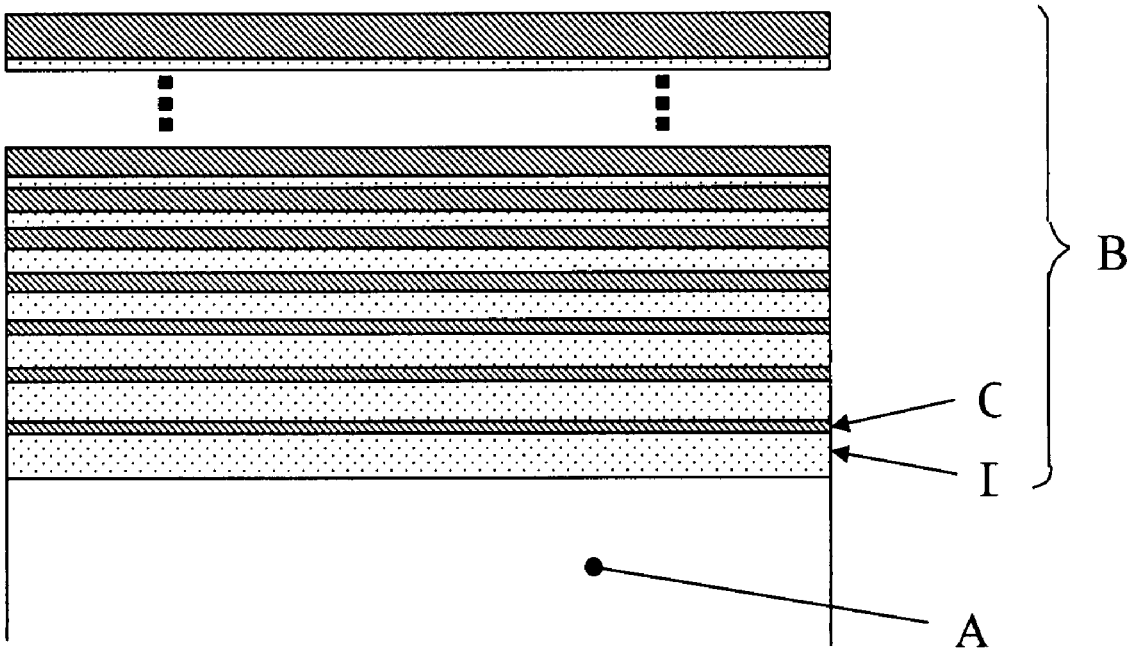
FIG. 1 is a schematic representation of a cross section taken through a coated cutting tool of the present invention showing a showing a substrate, A, coated with a laminated multilayer, B, comprising alternating metal oxide+metal oxide nano-composite layers of type C and metal oxide+metal oxide nano-composite layers of type D.

According to the present invention there is provided a cutting tool for metal machining such as turning, milling and drilling comprising a substrate of a hard alloy of cemented carbide, cermet, ceramics, cubic boron nitride or high speed steel, preferably cemented carbide or cermet, onto which a wear resistant coating comprising a laminated multilayer has been deposited. The shape of the cutting tool includes indexable inserts as well as shank type tools such as drills, end mills etc. The coating may in addition comprise, beneath the laminated multilayer, at least one first, inner single layer or multilayer of metal carbides, nitrides or carbonitrides where the metal atoms are one or more of Ti, Nb, V, Mo, Zr, Cr, Al, Hf, Ta, Y or Si with a thickness in the range from about 0.2 to about 20 μm according to prior art. The coating is applied onto the entire substrate or at least on the functioning surfaces thereof, e.g. the cutting edge, rake face, flank face and any other surfaces which participate in the metal cutting process.

The coating according to the invention is adherently bonded to the substrate and comprises a laminated multilayer of alternating PVD or PECVD metal oxide layers, $Me_1X$+$Me_2X$+$Me_1X$+$Me_2X$ . . . , where the metal atoms $Me_1$ and $Me_2$ are one or more of Ti, Nb, V, Mo, Zr, Cr, Al, Hf, Ta, Y and Si, preferably Hf, Ta, Zr and Al, most preferably Zr and Al, and where at least one of $Me_1X$ and $Me_2X$ is a nano-composite layer of a dispersed metal oxide component in a metal oxide matrix, hereinafter referred to as a metal oxide+metal oxide nano-composite, and wherein the laminated multilayer has a compositional gradient with regard to the concentration of one or more of the metal atom(s) in the direction from the outer surface of the coating towards the substrate, the gradient being such that the difference between the average concentration of the outermost portion of the multilayer and the average concentration of the innermost portion of the multilayer is at least about 5 at-% in absolute units. The layers $Me_1X$ and $Me_2X$ are different in composition or structure or both. The sequence of the individual $Me_1X$ or $Me_2X$ layer thicknesses is preferably aperiodic throughout the entire multilayer. By aperiodic is understood that the thickness of a particular individual layer in the laminated multilayer does not depend on the thickness of an individual layer immediately beneath nor does it bear any relation to an individual layer above the particular individual layer. Hence, the laminated multilayer does not have any repeat period in the sequence of individual coating thicknesses. Furthermore, the individual layer thickness is larger than about 0.4 nm but smaller than about 50 nm, preferably larger than about 1 nm and smaller than about 30 nm, most preferably larger than about 5 nm and smaller than about 20 nm. The laminated multilayer has a total thickness of between about 0.2 and about 20 μm, preferably about 0.5 and about 5 μm.

One individual metal oxide+metal oxide nano-composite layer is composed of at least two components with different composition and different structure. Each component is a single phase oxide of one metal element or a solid solution of two or more metal oxides. The microstructure of the material is characterized by nano-sized grains or columns of a component A with an average grain or column size of about 1 to about 100 nm, preferably from about 1 to about 70 nm, most preferably from about 1 to about 20 nm, surrounded by a component B. The mean linear intercept of component B is from about 0.5 to about 200 nm, preferably from about 0.5 to about 50 nm, most preferably from about 0.5 to about 20 nm.

The metal oxide+metal oxide nano-composite layer may be understoichiometric in oxygen content with an oxygen: metal atomic ratio which is from about 85 to about 99%, preferably from about 90 to about 97%, of stoichiometric oxygen:metal atomic ratio.

The volume contents of components A and B are from about 40 to about 95% and from about 5 about 60% respectively.

In one exemplary embodiment of the invention, the laminated multilayer is deposited directly onto a first, inner single layer or multilayer of metal carbides, nitrides or carbonitrides where the metal atoms are one or more of Ti, Nb, V, Mo, Zr, Cr, Al, Hf, Ta, Y and Si with a thickness in the range of about 0.2 to about 20 μm, where one or more of the metal atom(s) of the at least one metal oxide+metal oxide nano-composite layer is a stronger carbide or nitride former than one or more of the metal atom(s) in the first, inner single layer or multilayer. Furthermore it is preferred, in the laminated multilayer, that the concentration of metal atom(s) being the stronger carbide or nitride former of the at least one metal oxide+metal oxide nano-composite layer is increased in the direction from the outer surface of the coating towards the substrate.

In one exemplary embodiment of the present invention, $Me_1X$ is a metal oxide+metal oxide nano-composite layer containing grains or columns of component A and a surrounding component B, and $Me_2X$ is a metal oxide+metal oxide nano-composite layer containing grains or columns of component A and a surrounding component B. Component A of $Me_1X$ is the same as component A of $Me_2X$ as is component B of $Me_1X$ and $Me_2X$, but the metal atom(s) of component A is different from the metal atom(s) of component B. The volume content of component A in $Me_1X$ is >the volume content of component A in $Me_2X$, preferably the volume content of components A in $Me_1X$ is at least about 2.5% more than the volume content of components A in $Me_2X$ in absolute units, most preferably the volume content of components A in $Me_1X$ is at least about 5% more than the volume content of components A in $Me_2X$ in absolute units. The laminated multilayer has a compositional gradient in the metal atom(s) of component A, as well as a compositional gradient in the metal atom(s) of component B, the direction of increasing metal atom(s) content in the laminated multilayer being opposite for component A and component B, due to a shift in the relation of the average $Me_1X$ and/or $Me_2X$ layer thicknesses throughout the multilayer.

In another exemplary embodiment of the present invention, $Me_1X$ is a metal oxide+metal oxide nano-composite layer and $Me_2X$ is a metal oxide+metal oxide nano-composite layer. The metal atom(s) of component A of $Me_1X$ is different from the metal atom(s) of component A of $Me_2X$. Component B of $Me_1X$ is the same as component B of $Me_2X$. The volume content of component A in $Me_1X$ is equal to the volume content of component A in $Me_2X$. The laminated multilayer has a compositional gradient in the metal atom(s) of component A, due to a shift in the relation of the average $Me_1X$ and/or $Me_2X$ layer thicknesses throughout the multilayer. The average content of metal atom(s) of component A of $Me_1X$ may e.g. be close to zero percent in the innermost part of the multilayer, i.e., the average $Me_1X$ layer thickness is close to zero, hence the average content of metal atom(s) of component A of $Me_2X$ is maximized. The average content of metal atom(s) of component A of $Me_1X$ may increase to a maximum content towards the outermost part of the multilayer due to a gradually increased average $Me_1X$ layer thickness towards the outermost part of the multilayer.

In another exemplary embodiment of the present invention, the first, inner single layer or multilayer comprises a Ti based carbide, nitride or carbonitride. $Me_1X$ is a metal oxide+metal oxide nano-composite layer containing grains or columns of component A, preferably in the form of tetragonal or cubic zirconia, and a surrounding component B, preferably in the form of amorphous or crystalline alumina being one or both of alpha ($\alpha$) and gamma ($\gamma$) phase, and $Me_2X$ is a $Al_2O_3$ layer, preferably being one or both of alpha ($\alpha$) and gamma ($\gamma$) phase. The laminated multilayer has a compositional gradient in the metal atom(s) of component A, due to a shift in the relation of the average $Me_1X$ and/or $Me_2X$ layer thicknesses throughout the multilayer.

In another embodiment, the first, inner single layer or multilayer comprises a Ti based carbide, nitride or carbonitride. $Me_1X$ is a metal oxide+metal oxide nano-composite layer containing grains or columns of component A in the form of an oxide of hafnium and a surrounding component B in the form of amorphous or crystalline alumina being one or both of alpha ($\alpha$) and gamma ($\gamma$) phase, and $Me_2X$ is a $Al_2O_3$ layer, preferably being one or both of alpha ($\alpha$) and gamma ($\gamma$) phase. The laminated multilayer has a compositional gradient in the metal atom(s) of component A, due to a shift in the relation of the average $Me_1X$ and/or $Me_2X$ layer thicknesses throughout the multilayer.

The coating may in addition comprise, on top of the laminated multilayer, at least one outer single layer or multilayer of metal carbides, nitrides or carbonitrides where the metal atoms are one or more of Ti, Nb, V, Mo, Zr, Cr, Al, Hf, Ta, Y and Si. The thickness of this layer is from about 0.2 to about 5 μm.

The layer according to the present invention is made by a PVD technique, a PECVD technique or a hybrid of such techniques. Examples of such techniques are RF (Radio Frequency) magnetron sputtering, DC magnetron sputtering and pulsed dual magnetron sputtering (DMS). The layer is formed at a substrate temperature of from about 200 to about 850° C.

When the type of PVD process permits, a metal oxide+metal oxide nano-composite layer is deposited using a composite oxide target material. A reactive process using metallic targets in an ambient reactive gas is an alternative process route. For the case of production of the metal oxide layers by a magnetron sputtering method, two or more single metal targets may be used where the metal oxide+metal oxide nano-composite composition is steered by switching on and off of separate targets. In a preferred method a target is a compound with a composition that reflects the desired layer composition. For the case of radio frequency (RF) sputtering, the composition is controlled by applying independently controlled power levels to the separate targets.

The aperiodic layer structure may be formed through the multiple rotation of substrates in a large scale PVD or PECVD process.

The invention is additionally illustrated in connection with the following examples, which are to be considered as illustrative of the present invention. It should be understood, however, that the invention is not limited to the specific details of the examples.

Example 1

An aperiodic laminated multilayer consisting of alternating metal oxide+metal oxide nano-composite $Al_2O_3$+$ZrO_2$ layers and $Al_2O_3$ layers, was deposited on a substrate using an RF sputtering PVD method.

The nano-composite layers were deposited with high purity oxide targets applying different process conditions in terms of temperature and zirconia to alumina ratio. The content of the two oxides in the formed nano-composite layer was controlled by applying one power level on the zirconia target and a separate power level on the alumina target. Alumina was added to the zirconia flux with the aim to form a composite material having metastable $ZrO_2$ phases. The target power level for this case was 80 W on each oxide target. The sputter rates were adjusted to obtain two times higher at-% of zirconium compared to aluminium. The oxygen:metal atomic ratio was 94% of stoichiometric oxygen:metal atomic ratio.

The $Al_2O_3$ layers were deposited using alumina targets in an argon atmosphere.

The sputter times for the respective alternating layers were chosen to successively increase the $Al_2O_3$ layer thickness towards the coating surface.

The resulting layers were analyzed by XRD and TEM. The XRD analysis showed no traces of crystalline $Al_2O_3$ in the nano-composite layer, while the $Al_2O_3$ layers consisted mainly of gamma $Al_2O_3$.

The TEM investigation showed that the deposited coating consisted of a laminated multilayer of alternating metal oxide+metal oxide nano-composite layers, comprising grains with an average grain size of 4 nm (component A) surrounded by an amorphous phase with a linear intercept of 2 nm (component B), and gamma $Al_2O_3$ layers. The grains of the nano-composite layers were cubic $ZrO_2$ while the surrounding phase had high aluminium content. The individual layer thicknesses ranged from 4 to 20 nm and the total multilayer thickness was about 1 μm. The successive increase in the $Al_2O_3$ layer thickness towards the coating surface resulted in a Zr gradient such that the average Zr content was about 30 at-% higher, in absolute units, in the innermost portion than in the outermost portion of the multilayer, measured as an average Zr content over several consecutive layers in the respective portions using EDS.

The relative volume content of the two components A and B in the nano-composite layers was approximately 70% and 30%, respectively, as determined from ERDA analysis and EDS line scans from TEM images.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A cutting tool comprising a substrate of cemented carbide, cermet, ceramics, cubic boron nitride or high speed steel on which at least on the functioning parts of the surface thereof a thin, adherent, hard and wear resistant coating is applied, wherein said coating comprises a laminated multilayer of alternating PVD or PECVD metal oxide layers, $Me_1X$+$Me_2X$+$Me_1X$+$Me_2X$ . . . , where the metal atoms $Me_1$ and $Me_2$ are one or more of Ti, Nb, V, Mo, Zr, Cr, Al, Hf, Ta, Y and Si, where at least one of $Me_1X$ and $Me_2X$ is a metal oxide+metal oxide nano-composite layer composed of two components, component A and component B, with different composition and different structure which components comprise a single phase oxide of one metal element or a solid solution of two or more metal oxides, wherein the layers $Me_1X$ and $Me_2X$ are different in composition or structure or both and have individual layer thicknesses larger than about 0.4 nm but smaller than about 50 nm and where said laminated multilayer has a total thickness of between about 0.2 and about 20 μm and wherein the laminated multilayer has a compositional gradient, with regard to a concentration of one or more of the metal atom(s), in a direction from an outer surface of the coating towards the substrate, the gradient being such that a difference between an average concentration of an outermost portion of the multilayer and an average concentration of an innermost portion of the multilayer is at least about 5 at-% in absolute units.

2. Cutting tool of claim 1 wherein the said individual $Me_1X$ and $Me_2X$ layer thicknesses are larger than about 1 nm and smaller than about 30 nm.

3. Cutting tool of claim 1 wherein the coating in addition comprises a first, inner single layer or multilayer of metal carbides, nitrides or carbonitrides with a thickness between about 0.2 and about 20 μm where the metal atoms are chosen from one or more of Ti, Nb, V, Mo, Zr, Cr, Al, Hf, Ta, Y or Si.

4. Cutting tool of claim 3 wherein one or more of the metal atom(s) of the at least one metal oxide+metal oxide nano-composite layer is a stronger carbide or nitride former than one or more of the metal atom(s) in the first, inner single layer or multilayer.

5. Cutting tool of claim 1 wherein the coating in addition comprises, on top of the laminated multilayer, at least one outer single layer or multilayer coating of metal carbides, nitrides or carbonitrides with a thickness between about 0.2 and about 5 μm where the metal atoms are chosen from one or more of Ti, Nb, V, Mo, Zr, Cr, Al, Hf, Ta, Y or Si.

6. Cutting tool of claim 1 wherein said component A has an average grain size of from about 1 to about 100 nm.

7. Cutting tool of claim 1 wherein said component B has a mean linear intercept of from about 0.5 to about 200 nm.

8. Cutting tool of claim 1 wherein volume contents of components A and B are from about 40 to about 95% and from about 5 to about 60%, respectively.

9. Cutting tool of claim 1 wherein said component A contains tetragonal or cubic zirconia and said component B comprises amorphous or crystalline alumina, of one or both of the alpha (α) and the gamma (γ) phase.

10. Cutting tool of claim 1 wherein $Me_1X$ is a metal oxide+metal oxide nano-composite layer and $Me_2X$ is crystalline alumina layer of one or both of the alpha (α) and the gamma (γ) phase.

11. Cutting tool of claim 1 wherein said metal atoms $Me_1$ and $Me_2$ are one or more of Hf, Ta, Cr, Zr and Al.

12. Cutting tool of claim 11 wherein said metal atoms are one or more of Zr and Al.

13. Cutting tool of claim 6 wherein said component A has an average grain size of about 1 to about 70 nm.

14. Cutting tool of claim 13 wherein said component A has an average grain size of about 1 to about 20 nm.

15. Cutting tool of claim 7 wherein said component B has a mean linear intercept of from about 0.5 to about 50 nm.

16. Cutting tool of claim 15 wherein said component B has a mean linear intercept of from about 0.5 to about 20 nm.

* * * * *